US010022953B2

(12) United States Patent
Hughes et al.

(10) Patent No.: US 10,022,953 B2
(45) Date of Patent: Jul. 17, 2018

(54) CAN DECORATOR APPARATUS AND METHOD

(71) Applicant: Crown Packaging Technology, Inc., Alsip, IL (US)

(72) Inventors: Grahame Hughes, Oxfordshire (GB); Katherine Roselaar, Berkshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/768,941

(22) PCT Filed: Feb. 20, 2014

(86) PCT No.: PCT/EP2014/053296
§ 371 (c)(1),
(2) Date: Aug. 19, 2015

(87) PCT Pub. No.: WO2014/128200
PCT Pub. Date: Aug. 28, 2014

(65) Prior Publication Data

US 2016/0001546 A1 Jan. 7, 2016

(30) Foreign Application Priority Data

Feb. 20, 2013 (GB) ..... 1303003.6
Mar. 13, 2013 (GB) ..... 1304488.8
(Continued)

(51) Int. Cl.
*B41F 17/00* (2006.01)
*B41F 17/22* (2006.01)
(Continued)

(52) U.S. Cl.
CPC ..... *B41F 17/006* (2013.01); *B41F 17/22* (2013.01); *B41F 31/16* (2013.01); *B41F 31/20* (2013.01);
(Continued)

(58) Field of Classification Search
CPC ..... B41F 17/14; B41F 17/18; B41F 17/20; B41F 17/28; B41F 17/006; B41F 17/22;
(Continued)

(56) References Cited

U.S. PATENT DOCUMENTS 3,520,253 A * 7/1970 Head, Jr. ..... B41F 27/005 101/181
3,766,851 A 10/1973 Sirvet et al.
(Continued)

FOREIGN PATENT DOCUMENTS

FR 2905630 A1 3/2008
GB 1242146 A 8/1971
(Continued)

OTHER PUBLICATIONS

"Response filed in European Patent Application No. 14705359.9", Marks&Clerk LLP, dated Jul. 12, 2016, 20 pages.
(Continued)

*Primary Examiner* — Jill Culler
*Assistant Examiner* — Marissa Ferguson Samreth
(74) *Attorney, Agent, or Firm* — Baker & Hostetler LLP

(57) ABSTRACT

Apparatus for decorating a can body. The apparatus comprises a can body conveying mechanism (1) for conveying can bodies (2) to a printing zone (3), a blanket wheel (4) comprising a plurality of blanket segments (6) and, affixed to each blanket segment, a blanket (7) having a printing surface, the blanket wheel being configured to bring blanket printing surfaces into contact with can bodies within said printing zone, and a plurality of ink stations (5) each
(Continued)

comprising a printing plate (31) configured to contact the printing surfaces of passing blankets in order to impart an ink image to the printing surfaces, such that a composite ink image is formed on each blanket printing surface and is printed onto a can body upon contact of the blanket printing surface and the can body within the printing zone. The apparatus is configured such that at least one of the blankets has a surface height variation across its printing surface representing a secondary image to be transferred to can bodies with which the blanket comes into contact. A drive mechanism (32) is provided for causing the printing plates to rotate and a drive mechanism controller for varying the rotational speed of the printing plates to synchronize the positions of the printing plates with blankets onto which ink images are to be transferred.

9 Claims, 14 Drawing Sheets

(30) Foreign Application Priority Data

Apr. 2, 2013 (GB) ..... 1305908.4
Aug. 30, 2013 (GB) ..... 1315457.0

(51) Int. Cl.

| | |
|---|---|
| ***B41F 31/16*** | (2006.01) |
| ***B41F 31/20*** | (2006.01) |
| ***B41F 33/00*** | (2006.01) |
| *B41M 1/06* | (2006.01) |
| *B41M 1/14* | (2006.01) |
| *B41M 1/40* | (2006.01) |

(52) U.S. Cl.
CPC ..... *B41F 33/00* (2013.01); *B41M 1/06* (2013.01); *B41M 1/14* (2013.01); *B41M 1/40* (2013.01); *B41P 2217/14* (2013.01)

(58) Field of Classification Search
CPC ..... B41F 31/16; B41F 31/20; B41F 33/00; B41P 2217/14; B41M 1/06; B41M 1/14; B41M 1/40
USPC ..... 101/38.1
See application file for complete search history.

(56) References Cited

U.S. PATENT DOCUMENTS

| | | | | |
|---|---|---|---|---|
| 5,181,471 | A | 1/1993 | Sillars | |
| 5,337,659 | A | 8/1994 | Whelan | |
| 2008/0236426 | A1* | 10/2008 | Cummings | B41C 1/1075 101/463.1 |
| 2008/0250960 | A1* | 10/2008 | Taylor | B41F 27/005 101/479 |
| 2010/0031834 | A1 | 2/2010 | Morgavi et al. | |
| 2010/0229737 | A1 | 9/2010 | Ouchi | |
| 2010/0257819 | A1 | 10/2010 | Schach | |
| 2012/0272846 | A1* | 11/2012 | Fleischer | B41F 17/22 101/38.1 |
| 2015/0290923 | A1 | 10/2015 | Treloar | |

FOREIGN PATENT DOCUMENTS

| | | | | |
|---|---|---|---|---|
| GB | 2504370 | A | 1/2014 | |
| JP | 63-159054 | * | 7/1988 | B41F 27/12 |
| JP | H06-505679 | | 6/1994 | |
| JP | 2001-138486 | | 5/2001 | |
| JP | 2010-502489 | | 1/2010 | |
| WO | WO 92/09435 | A1 | 6/1992 | |
| WO | WO 2009/044569 | | 4/2009 | |
| WO | WO 2012/054655 | A1 | 4/2012 | |
| WO | WO 2012/148576 | A1 | 11/2012 | |

OTHER PUBLICATIONS

European Patent Application No. 14705359.9-1704: Communication under Rule 164(2)(a) EPC dated Mar. 30, 2016, 11 pages.
European Patent Application No. 14705359.9-1704: Communication pursuant to Article 94)(3) EPC dated Sep. 27, 2016, 6 pages.

* cited by examiner

CAN DECORATOR APPARATUS AND METHOD

CROSS-REFERENCE TO RELATED APPLICATIONS

This application is the National Stage of International Application No. PCT/EP2014/053296, filed Feb. 20, 2014, which claims the benefit of GB application number 1303003.6, filed Feb. 20, 2013; GB application number 1304488.8, filed Mar. 13, 2013; GB application number 1305908.4, filed Apr. 2, 2013; and GB application number 1315457.0, filed Aug. 30, 2013, the disclosures of which are incorporated herein by reference in their entirety.

TECHNICAL FIELD

The present invention relates to a can decorator apparatus and method.

BACKGROUND ART

Metal cans such as steel and aluminium beverage cans are commonly manufactured in two pieces. A first part comprises a generally cylindrical container body with integral base, formed from a circular metal disk using a drawing and ironing process. A second part comprises an end having a tab or ring-pull formed therein. The can is filled, e.g. with beverage, and the end subsequently fixed to the body using a seaming process.

Can decorators are known in the art for applying decoration to the external surface of a can body. A typical decorator is used to apply decoration to the can body prior to filling of the can body and prior to seaming of the end. The prior art can decorator is a relatively complex apparatus, but is illustrated schematically in FIG. 1. On the left hand side of the illustration there is shown a can body conveying mechanism comprising a set of mandrels rotating about a common axis. Unprinted or "blank" can bodies are loaded onto the mandrels. These are then rotated into a printing zone where the can bodies are brought into contact, i.e. rolled across, pre-inked blankets mounted on a blanket wheel via respecting blanket segments. FIG. 1 illustrates a blanket wheel comprising eight blankets.

FIG. 1 also illustrates six ink stations, each comprising an ink reservoir, a printing plate (typically having an image embossed thereon), and a delivery mechanism for ensuring even application of ink from the reservoir to the printing plate. Each blanket passes through the ink stations in sequence such that a blanket leaving the final ink station has a composite (in this case, six colour) ink image formed on a printing surface thereof. This composite image is transferred to a can body in the printing zone. FIG. 2 further illustrates a 6 colour printing process, where the first five ink stations apply letters of the word "PRINT" in sequence in different colours. The final ink station (applying red ink) applies a background colour to the blanket. It will be appreciated that the word is formed in reverse on the blanket so that it appears correctly when transferred from the blanket printing surface to a can body.

In some production lines, can bodies may be pre-coated with a basecoat. This may be a white basecoat that is dried prior to the can bodies entering the can decorator (FIG. 1). The decorator then applies the colour decoration to the can body on top of the basecoat. In some cases, the basecoat may be a transparent basecoat.

The most common can decorators print different colours (i.e. corresponding to different ink stations) in non-overlapping areas of the can body. However, it is possible to print colours one on top of the other, i.e. different ink stations overprint different colours on the blankets. This is referred to as "wet-on-wet" printing.

Can decorators are described in more detail in WO 2012/148576 and U.S. Pat. No. 3,766,851.

Existing can decorators are extremely efficient at producing cans conforming to a common design. Several thousand cans per minute (e.g. 2400) can be produced by a single decorator. Even higher production rates can be achieved using so-called dual decorators which effectively use a pair of decorators aligned in parallel.

Beverage and other canning companies are extremely keen to introduce some degree of design differentiation between cans produced on single production line, i.e. using a single decorator, without having to interrupt production, e.g. to change printing plates. In particular, companies are keen to produce individual pallets including a mix of can designs. Although the required design differentiation may be relatively minor (in the context of the overall can design), e.g. designs may be differentiated by the printing of specific words at a certain position, it has proven extremely difficult to achieve this in a commercial production line.

DISCLOSURE OF INVENTION

According to a first aspect of the present invention there is provided an apparatus for decorating a can body and comprising: a can body conveying mechanism for conveying can bodies to a printing zone; a blanket wheel comprising a plurality of blanket segments and, affixed to each blanket segment, a blanket having a printing surface, the blanket wheel being configured to bring blanket printing surfaces into contact with can bodies within said printing zone; and a plurality of ink stations each comprising a printing plate configured to contact the printing surfaces of passing blankets in order to impart an ink image to the printing surfaces, such that a composite ink image is formed on each blanket printing surface and is printed onto a can body upon contact of the blanket printing surface and the can body within the printing zone, wherein at least one of said ink stations comprises a plurality of printing plates configured such that different printing plates contact printing surfaces of successive different blankets, the apparatus further comprising a drive mechanism for causing the printing plates to rotate and a drive mechanism controller for varying the rotational speed of the printing plates to synchronise the positions of the printing plates with blankets onto which ink images are to be transferred.

According to a further aspect of the invention the apparatus comprises a can body conveying mechanism for conveying can bodies to a printing zone, a blanket wheel comprising a plurality of blanket segments and, affixed to each blanket segment, a blanket having a printing surface, the blanket wheel being configured to bring blanket printing surfaces into contact with can bodies within said printing zone, and a plurality of ink stations each comprising a printing plate configured to contact the printing surfaces of passing blankets in order to impart an ink image to the printing surfaces, such that a composite ink image is formed on each blanket printing surface and is printed onto a can body upon contact of the blanket printing surface and the can body within the printing zone.

The apparatus is configured such that at least one of the blankets has a surface height variation across its printing surface representing a secondary image to be transferred to can bodies with which the blanket comes into contact.

The apparatus further comprises an alignment device such as a jig which is removably attachable to a support or to a blanket segment of the plurality of blanket segments, the jig further comprising an alignment surface against which a blanket can be positioned in order to allow the blankets and blanket segments to be correctly aligned such that, for each blanket printing surface, a composite ink image is correctly aligned with a secondary image.

The alignment surface of the jig may be "single edge" such that the blanket is supported at its trailing edge and a machine side of the blanket segment, flush fit to the trailing edge and with its lateral position determined by a profiled bar of the jig.

Alternatively, the jig may be "double edge" such that the blanket is supported at its trailing edge and the machine side of the segment, flush fit to both edges.

In yet another embodiment, the jig may have "zero edge" and the blanket is supported away from its trailing edge and the machine side of the segment, with both timing and lateral position of the blanket being determined by profiled "bars/stops" of the jig.

The alignment device may, instead of a mechanical device such as a jig, comprise features such as between 1 and 4 scribe lines on the blanket segment to indicate correct blanket position. Depending on the position needed, the number of scribe lines is chosen as a minimum of one and a maximum of four.

In this embodiment, scribe lines may be provided on both the blanket and the blanket segment so as to indicate the correct position. Ideally, the blanket marks should fall outside the printable areas so as not to interfere with the design.

The alignment device may comprise location pins in low relief, with reciprocating punch holes in an adhesive and webbing layer of the blanket. The punch holes should not be through top layers of the blanket so that the pins are not proud and the blanket sits flat. The pins and punch holes preferably sit in advance of the point at which a can first contacts the blanket on the leading edge of the can.

A final form of alignment device may comprise a non-contact alignment device. One of these is a rapidly oscillating beam known as a "laser curtain" in one or two directions at 90° to each other to indicate correct positioning. The beam is ideally a laser which would be "invisible" in that it is without any form of atmospheric scatter, but would produce an indicator line(s) on the segment surface. The advantage of the laser curtain is that it avoids the need for tools and/or marking/damage to the blanket segment.

A second non-contact alignment device uses a magnetic zone or fields to attach and/or locate the blanket correctly. A third non-contact alignment device comprises removable blanket segments with blankets pre-fitted and precision aligned off-machine. Alignment "aid" is then developed to allow the segment to be re-fitted accurately. A very robust and well-engineered quick-release mechanism is required for this alignment device in order to make changed up to twelve of these assemblies viable. It is believed the change-over would only require change of a part of the segment, for example a top surface.

A typical embodiment of the invention will implement the blanket segments and respective blankets as discrete blanket segments and blankets, e.g. with spaces between adjacent blanket segments and blankets. However, an alternative embodiment may implement one or both of these components as sectors of a continuous component. For example, the blankets may each comprise a section of a continuous blanket belt that is secured around the periphery of the blanket wheel, on top of the blanket segments.

Other aspects of the invention are set out in the appended claims.

MODE(S) FOR CARRYING OUT THE INVENTION

Figure 1:
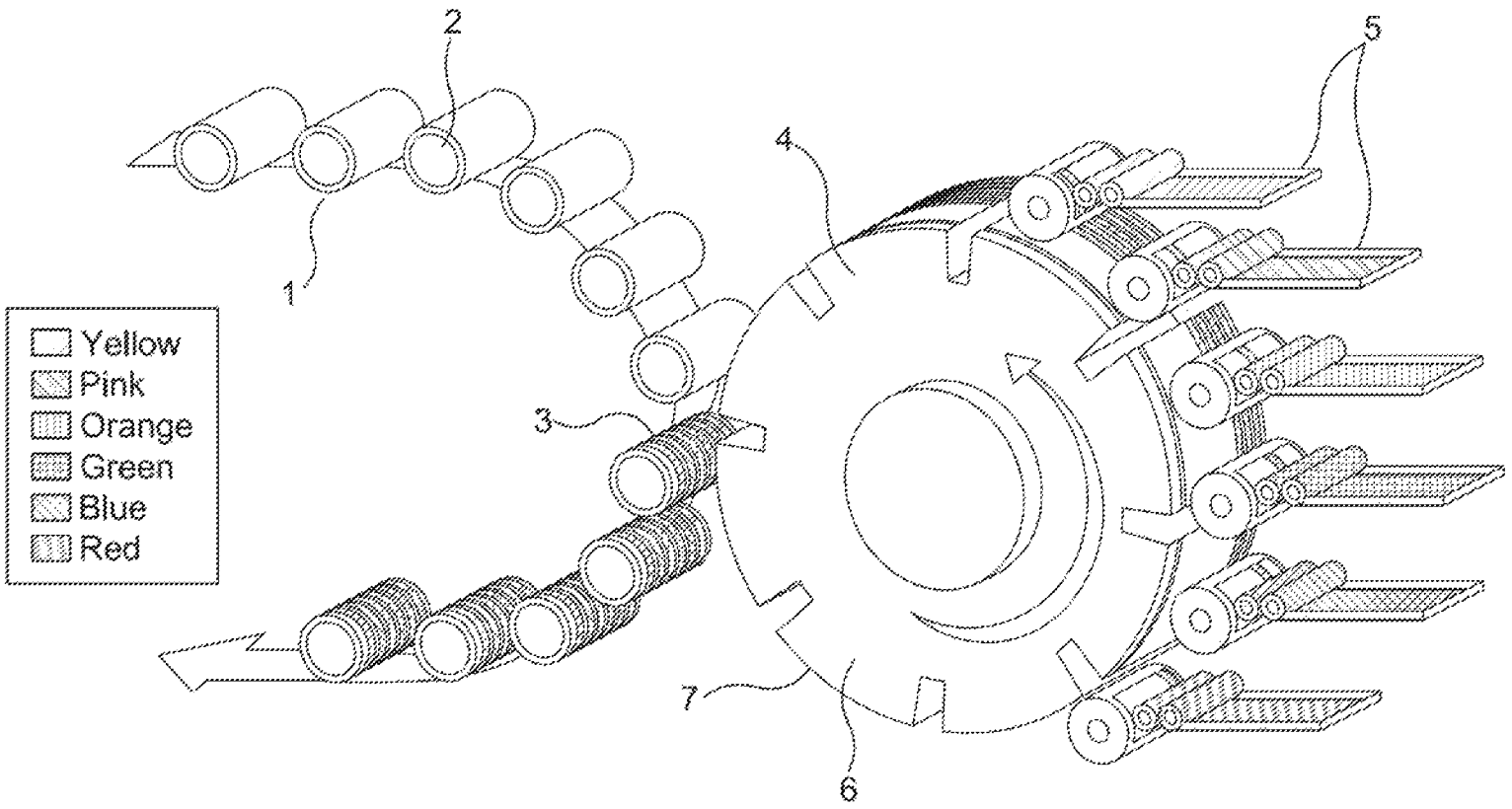
Figure 1 (PRIOR ART)
FIG. 1 illustrates schematically a can decorator apparatus according to the prior art.
Figure 2:
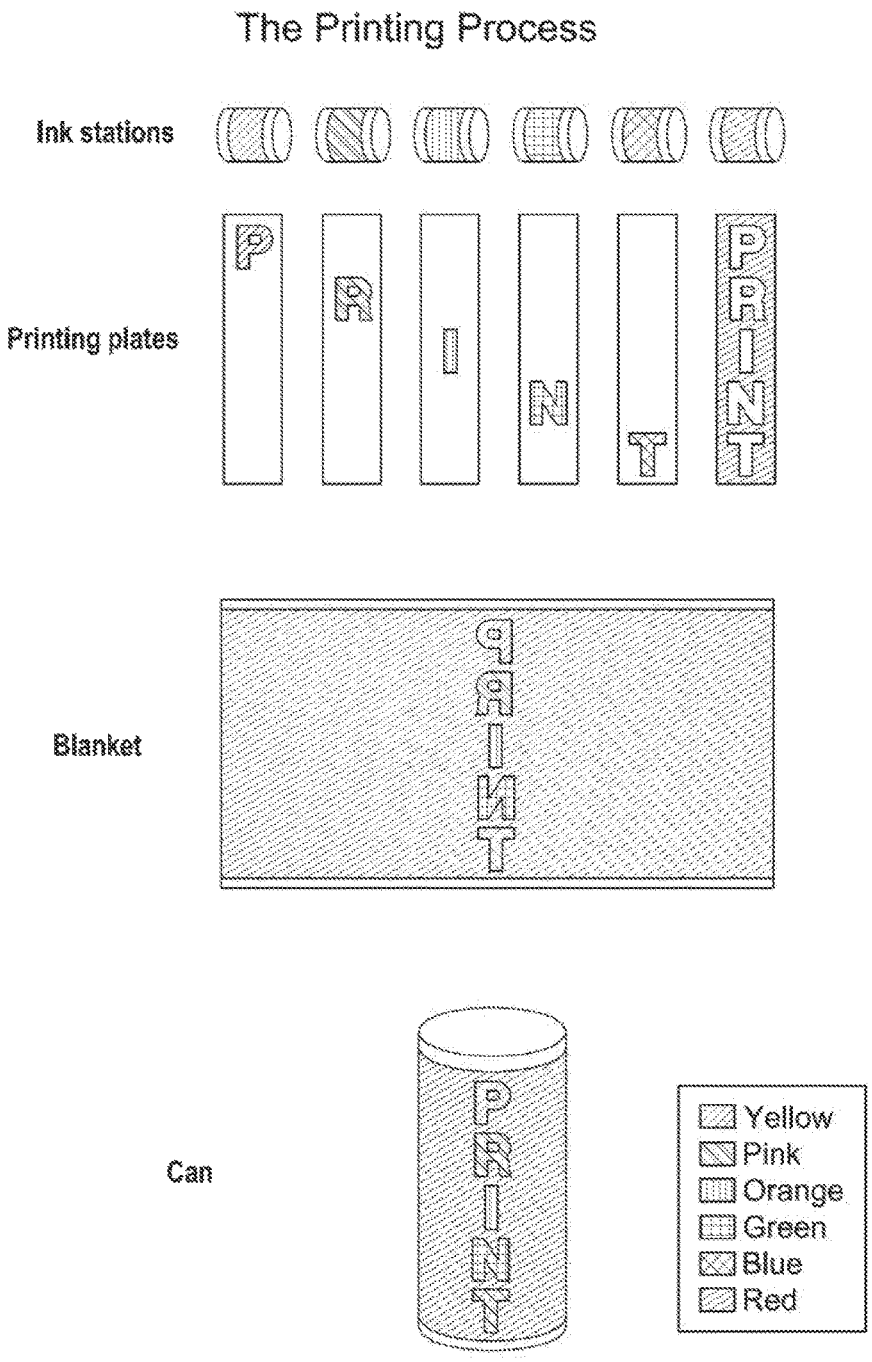
Figure 2 (PRIOR ART)
FIG. 2 illustrates schematically a process carried out using the apparatus of FIG. 1.

A can decorator apparatus has been described in general terms with reference to FIGS. 1 and 2. The decorator apparatus includes in particular: a can body conveying mechanism 1 for delivering can bodies 2 in sequence to a printing zone 3; a blanket wheel 4; and a series of ink stations 5. Other components of the can decorator apparatus will be known to the skilled person and will not be described here. Rather, reference should be made to prior art disclosures including for example WO 2012/148576 and U.S. Pat. No. 3,766,851.

Considering further the blanket wheel 4, this is configured to rotate around a central axis and comprises a set of blanket segments 6 to each of which is affixed a blanket 7. Blankets are usually flexible sheets removably secured to blanket segments using an adhesive. Blankets may have a laminar construction, e.g. a bottom webbing, an intermediate compressible layer, and a top rubber or elastomeric layer (other layers including an intermediate webbing may be provided). The upper surface of the rubber or elastomeric layer forms a printing surface of the blanket. Due to wear, blankets are periodically removed and replaced by production line operators. Whilst FIG. 1 illustrates a single line decorator, it will be appreciated that dual line decorators are known and which are able to simultaneously decorate two parallel lines of can bodies.

As has been noted above, a problem with existing can decorators is that it is not possible to vary the decoration within a given line, at least not without stopping the production line and, e.g. changing printing plates within the ink stations 5. To address this problem, it is proposed here to supplement the primary decorative design or image that is formed on the printing surfaces of blankets 7 by the printing plates, with one or more secondary images 8 formed by introducing variations in height across the printing surfaces 9 of the blankets 7. This concept prevents the adhesion of ink to those areas of the printing surfaces having a reduced height and/or prevents ink being printed onto the can body (due to non-contact). This secondary image 8 may vary between blankets on the blanket wheel 4, allowing multiple different decorative designs to be printed on different can bodies within the same line. Referring to the decorator of FIG. 1, this includes eight blanket segments 6 allowing the use of up to eight different blankets 7 to produce eight different designs within the same production line.

Figure 3:
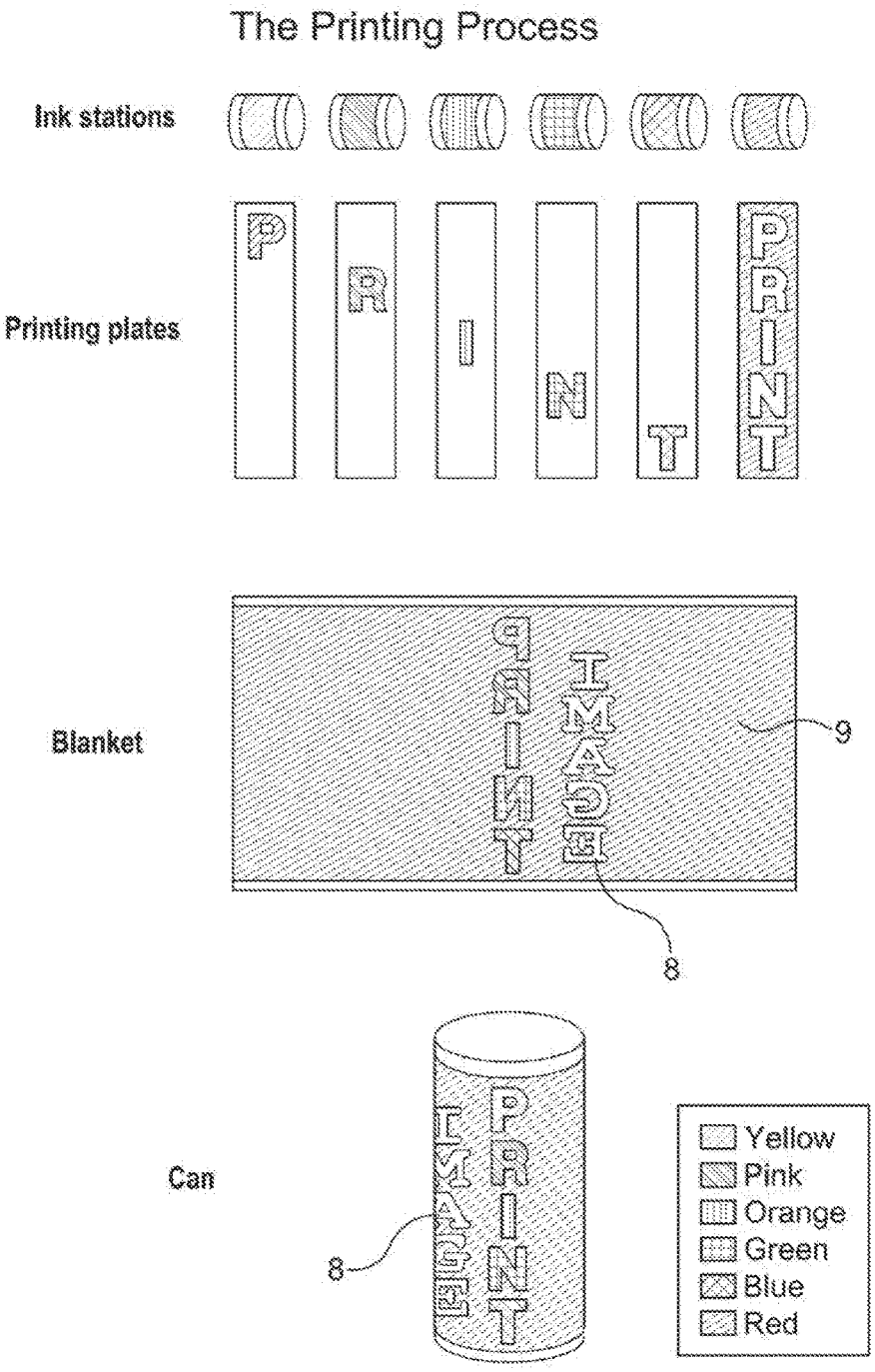
FIG. 3 illustrates schematically an improved can decorating process making use of a secondary image formed in the blanket printing surface.

FIG. 3 illustrates a modification made to the prior art decoration process and apparatus of FIGS. 1 and 2. Whilst the ink stations 5 and associated printing plates produce the same multi-colour composite image (the primary image) on the passing blankets ("PRINT" with a red background), the blanket illustrated has the (reversed) text "IMAGE" (the secondary image) cut or etched into its printing surface 9. Red ink will not adhere to this cut or etched region. [NB. Modification of the form rollers within the ink stations may be required to smooth out or remove any ink that remains on the printing plates due to non-adhesion to the blanket printing surface, but the form of such modification will be readily apparent to the skilled person.] When the blanket 7 is brought into contact with a can body 2 within the printing zone 3, the primary image (i.e. "PRINT" with a red background) will be printed onto the can body 2. However, red ink will not be printed onto the body where the cut out or etched secondary image resides, causing the image "IMAGE" to appear on the can as an unprinted region, i.e. as a negative.

Figure 4:
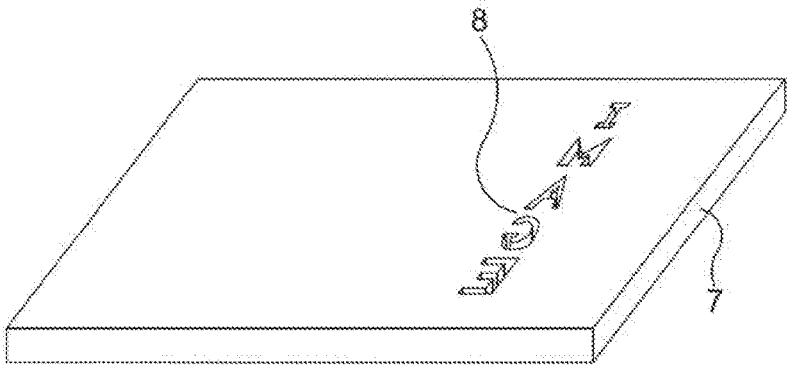
FIG. 4 illustrates schematically and in perspective view a blanket having an etched or cut-away secondary image therein in order to allow printing of a negative of the secondary image.

FIG. 4 illustrates a perspective view of the blanket 7 with the cut away or etched area ("IMAGE"). The text may be formed by removing or etching completely through the blanket, or by removing or etching (at least part-way) through one or more upper layers. The blanket 7 may also be formed by cutting through a single thin layer, and adhering this layer to a blanket backing. Such a configuration may even allow the backing to remain attached to a blanket segment for a prolonged period, with only the top layer being removed and attached more frequently.

Figure 6:
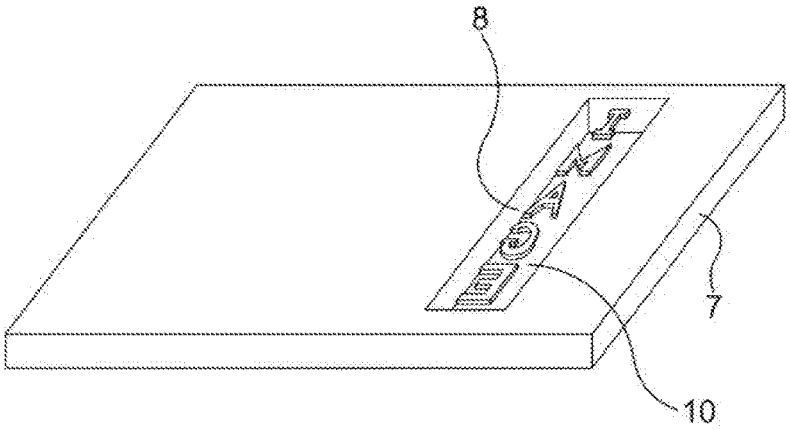
FIG. 6 illustrates schematically and in perspective view a blanket having an etched or cut-away secondary image therein in order to allow printing of a positive of the secondary image, and FIG. **6*a*** illustrates schematically a blanket and printing plate for forming a positive secondary image.
Figure 5:
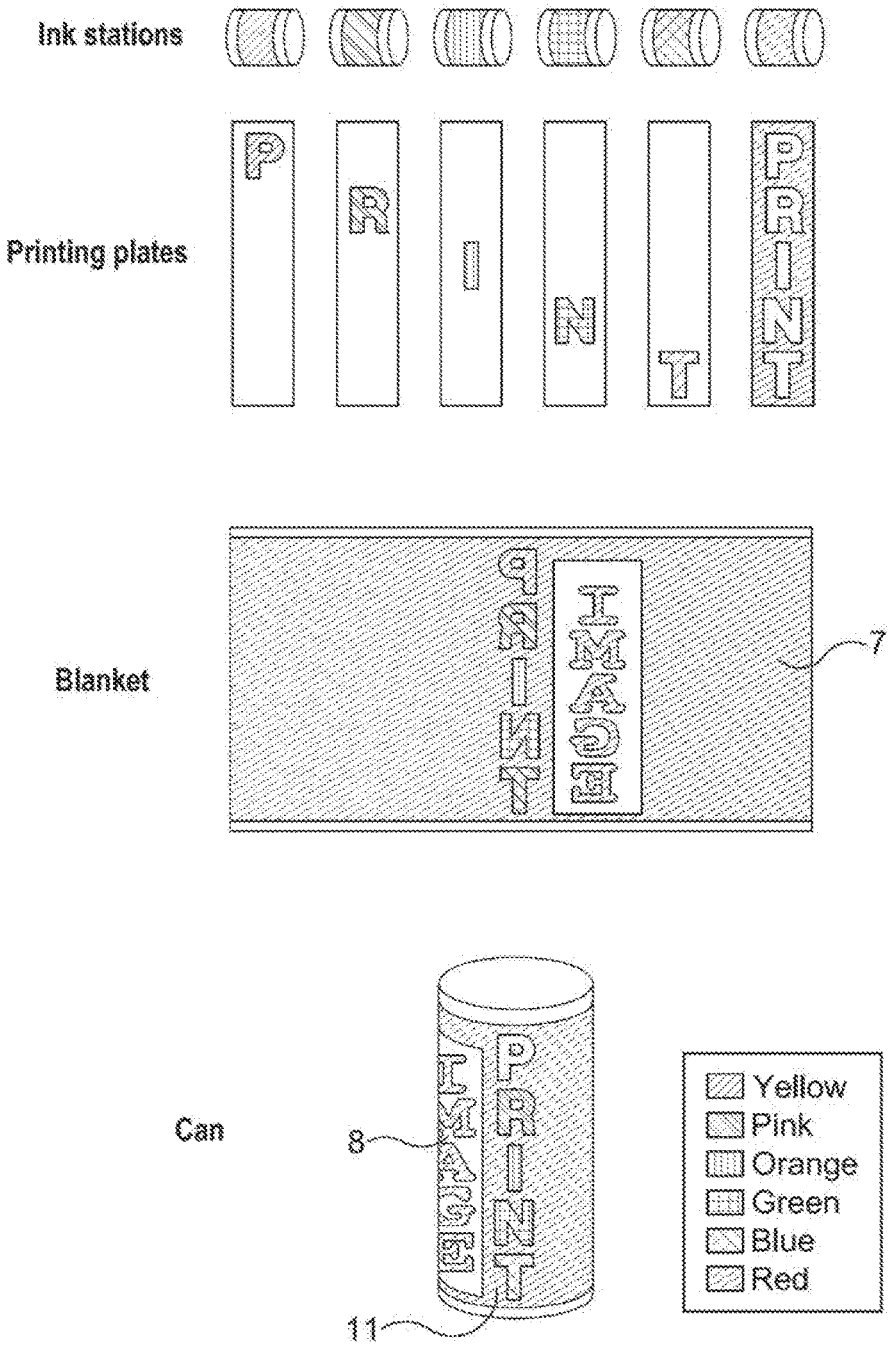
FIG. 5 illustrates schematically an improved can decorating process making use of a secondary image formed in the blanket printing surface to form a positive secondary image.

FIG. 5 illustrates an alternative process making use of the blanket illustrated in FIG. 6. This allows the secondary image ("IMAGE") to be printed onto the can body as a positive image, rather than appearing as a negative. With reference to FIG. 6, the height variation on the printing surface is such as to leave the secondary image 8 sitting as an island within a surrounding area 10 of lower or reduced height. This printing surface configuration is such that ink adheres to the upper surface of the secondary image, as well as to the general primary image area, but does not adhere to those areas 10 immediately surrounding the secondary image. Referring to FIG. 5, a rectangular area 11 surrounding the secondary image ("IMAGE") on the can body remains unprinted.

Figure 6A:
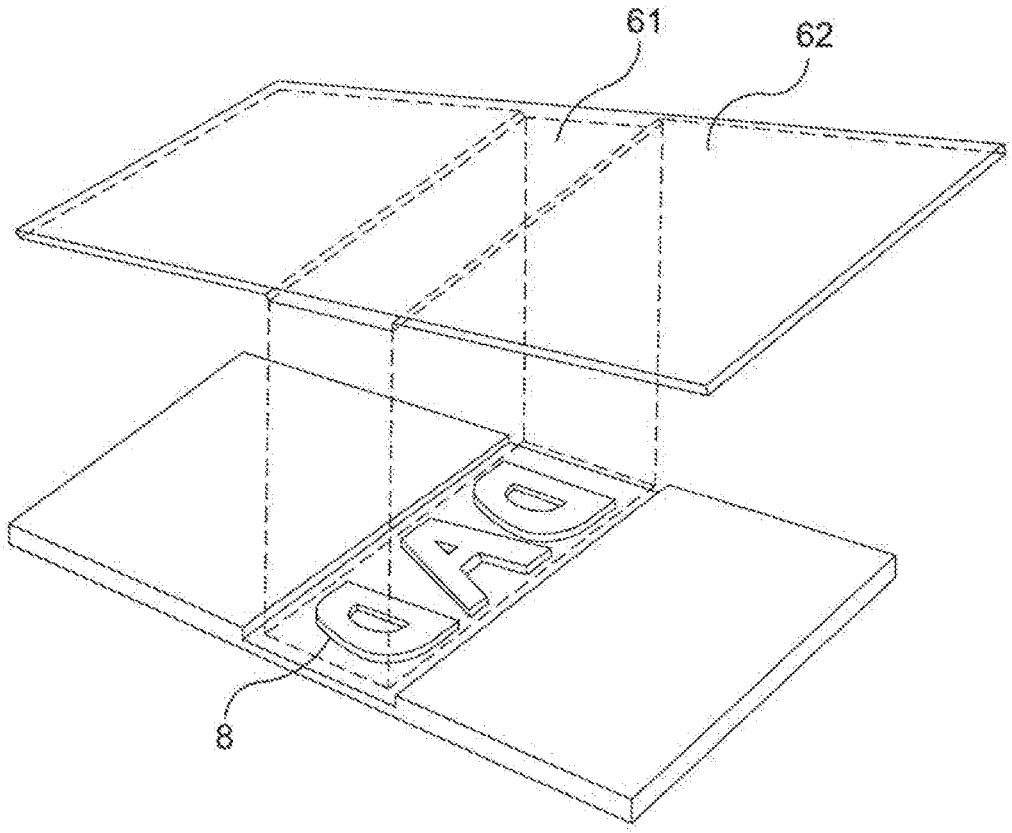

Note that the blanket 7 shown in FIG. 6 only has small area (the word "IMAGE") that requires inking. Using a regular inking roller at an inking station, the entire blanket 7 would have ink applied to it and this would be transferred to the can. This is undesirable if only the positive image is required. In order to address this, a system as shown in FIG. 6*a* is suggested. The secondary image 8 is the only area that requires inking. An element 61 of a printing plate 62 is used as an ink delivery surface or 'inking pad'. The raised element 61 picks up ink and only applies it to the positive image 8 on the blanket rather than to the whole blanket. The movement of the raised element 61 is timed and registered to correspond to the raised elements in the blanket cut out. The raised element 61 is sized so that it does not interfere with the blanket area outside the cut out.

Figure 7:
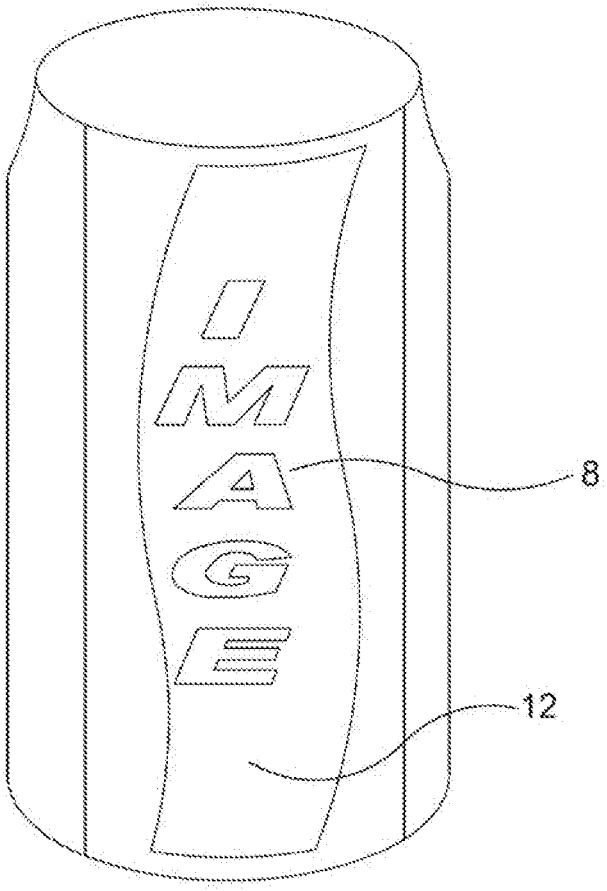
FIG. 7 illustrates schematically a can decorated using the blanket of FIG. 5.

A more attractive design may be achieved if the reduced height region lies wholly within a region of the primary design that is unprinted. This is illustrated in FIG. 7, where the secondary image "IMAGE" appears in the design within a general unprinted "swirl" 12 of the primary image.

It is noted that with prior art decorators, as the blankets have a larger surface area than the can bodies, exact alignment of the blankets and the blanket segments is not required. The ink stations are aligned such that the composite image will appear on the blanket at the correct position relative to the printing zone and the presented can bodies. However, the introduction of a secondary image on the blanket 7 introduces a requirement for precise alignment between the blankets 7 and the blanket segments 6. If such alignment is not achieved, the secondary image 8 will appear on the can body 2 in an incorrect position. Alignment features on the blanket and the blanket segments should therefore be provided. These features should allow both for longitudinal alignment of the blanket along the length of the blanket segment and for correct angular alignment around the blanket segment, i.e. to prevent "twisting" of the blanket. As outlined above, alignment is further enhanced by the use of an alignment device in addition to alignment features. One example of alignment device is a jig, either with single edge, double edge or even zero edge.

Figure 8:
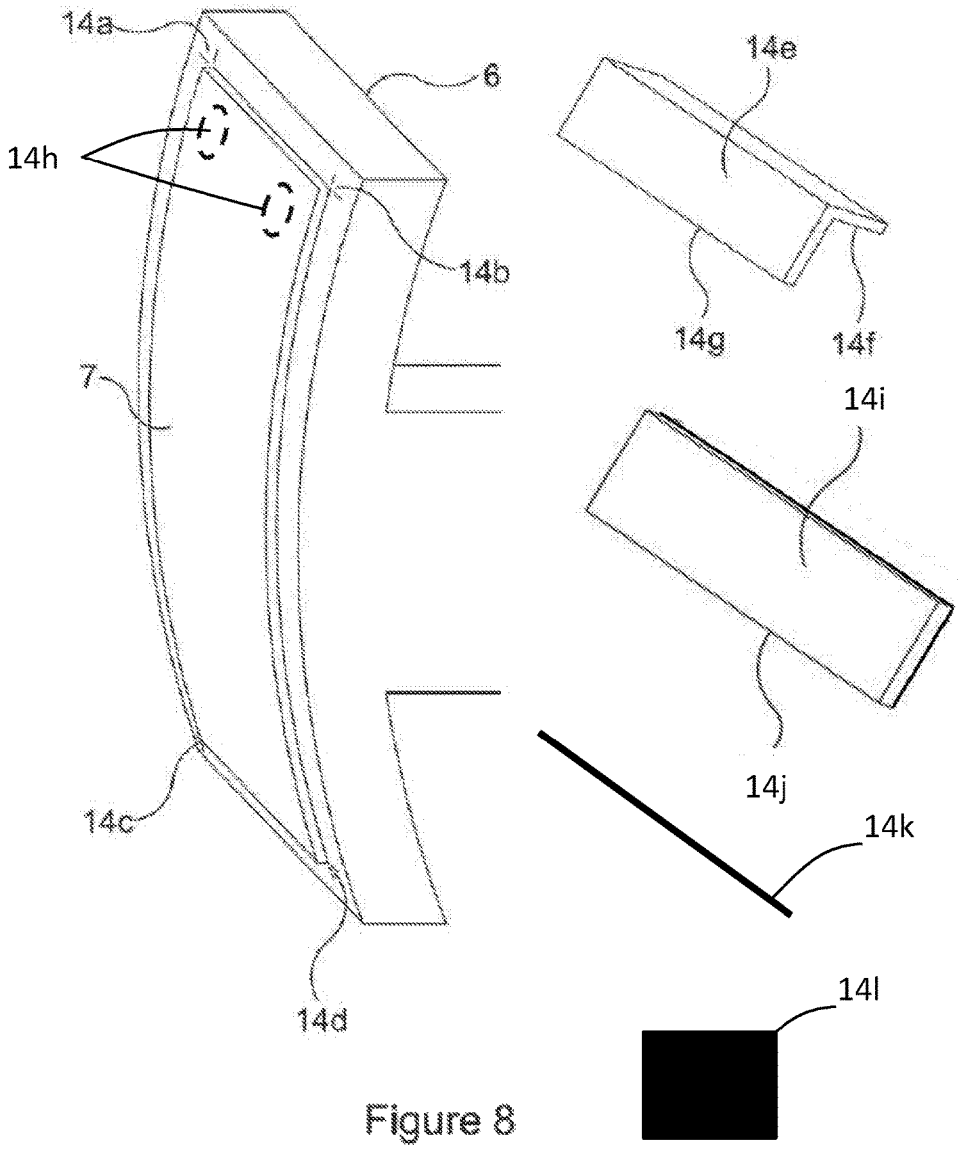
FIG. 8 illustrates schematically a blanket segment and an attached blanket segment, the blanket segment being provided with alignment markings.

There is illustrated in FIG. 8 a blanket 7 aligned to a blanket segment 6 of the blanket wheel 4. The blanket segment 6 is provided with a set of four alignment marks 14*a-d* corresponding to each of the corners of the blanket 7. A line operator is responsible for attaching the blanket to the blanket segment such that the four corners of the blanket are aligned with respective alignment marks. Alternatively, or in addition, alignment features may be provided on the printing surface or edges of the blanket.

As an alternative or additional arrangement, a jig 14*e* is shown. The jig 14*e* is a structure that may be temporarily placed on the blanket segment 6 by an operator. The jig 14*e* shown in FIG. 8 is a simple arrangement that an operator places against an end-surface of the blanket segment 6 when a new blanket 7 is being fitted. A first surface of the jig 14*f* abuts a corresponding surface of the blanket segment 6. The operator can then abut an edge of the blanket 7 against a second surface 14*g* of the jig 14*e*. This jig thus has a "double edge" which allows the blanket 6 to be precisely aligned with respect to the blanket segment 7.

It will be appreciated that various different designs of jig may be used that can be temporarily attached to the blanket segment in a variety of ways, depending on features of the blanket segment. For example, if the blanket segment has punch holes or openings in a layer of the blanket, then the alignment device or jig can be provided with corresponding location pins 14*h* or lugs in low relief to fit into those openings. Alternatively, the alignment surface 14*i* of a jig 14*j* may be "single edge" such that the blanket is supported at its trailing edge and a machine side of the blanket segment, flush fit to the trailing edge and with its lateral position determined by a profiled bar of the jig. In yet another embodiment, the jig 14*k* may have "zero edge" and the blanket is supported away from its trailing edge and the machine side of the segment, with both timing and lateral position of the blanket being determined by profiled "bars/stops" of the jig 14*k*. A final form of alignment device may comprise a non-contact alignment device 14l. One of these non-contact alignment devices 14l is a rapidly oscillating beam known as a "laser curtain" in one or two directions at 90° to each other to indicate correct positioning. The beam is ideally a laser which would be "invisible" in that it is without any form of atmospheric scatter, but would produce an indicator line(s) on the segment surface. The advantage of the laser curtain is that it avoids the need for tools and/or marking/damage to the blanket segment.

Once the blanket 7 has been accurately aligned on the blanket segment 6 using the alignment device or jig 14*e*, and affixed to the blanket segment 6, the jig 14*e* is removed and can be re-used for aligning further blankets with further blanket segments.

Figure 9:
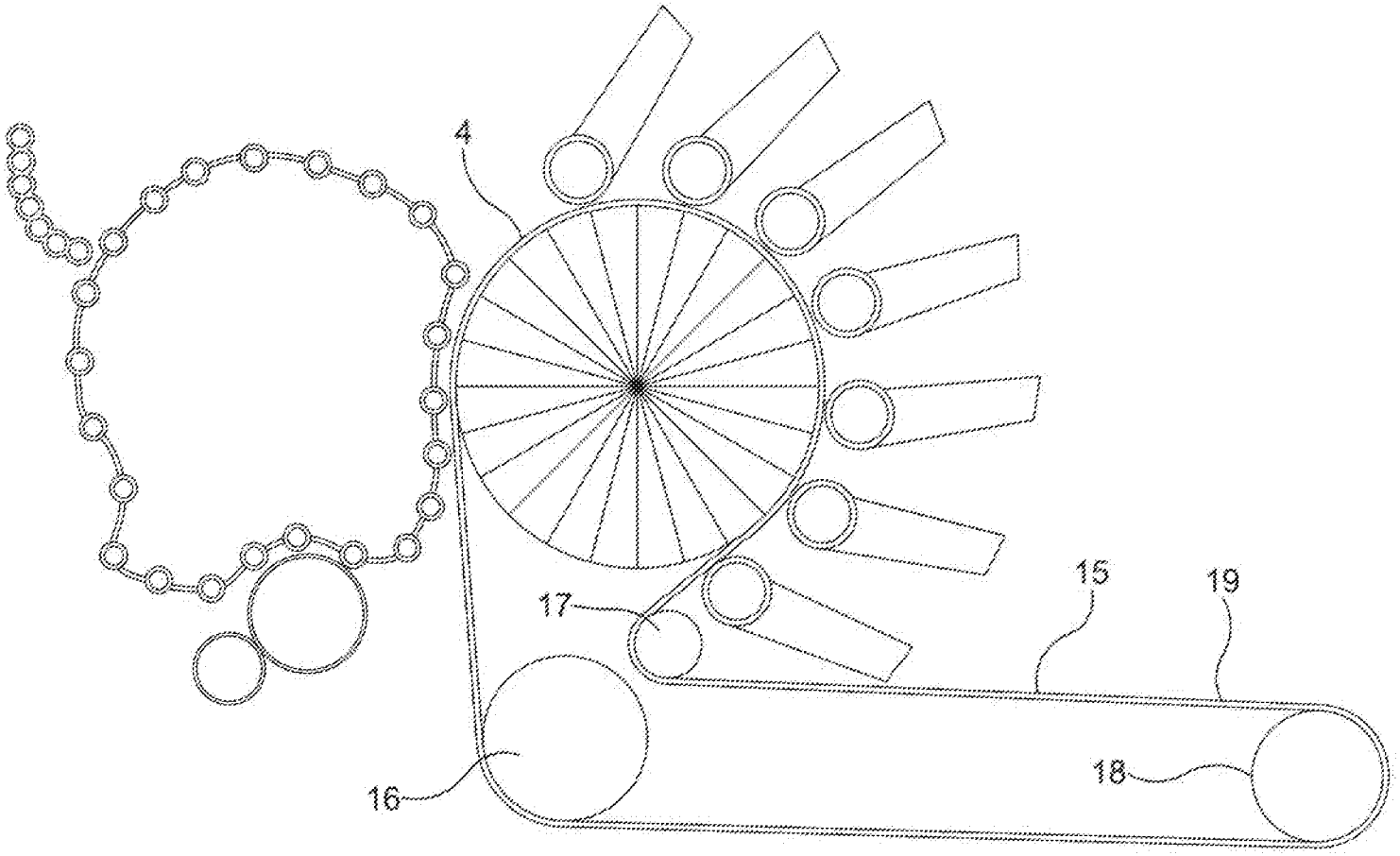
FIG. 9 illustrates schematically a modified can decorator apparatus comprising a continuous blanket belt.

Referring now to FIG. 9, a modification to the above described can decorator involves replacing the individual, discrete, blankets 7 with a continuous blanket roll or belt 15. As well as being supported by the blanket wheel 4, the blanket roll extends around three additional rollers 16, 17 and 18. These rollers may be free to rotate, or may be driven to assist movement of the blanket roll around the blanket wheel and through the printing zone 3. It will be appreciated that the length of the blanket roll can be much greater than the circumference of the blanket wheel.

According to this embodiment, individual blankets 7 are defined as successive sections or zones 19 of the blanket belt 15. Consistent with the embodiments described above however, secondary images are etched or otherwise incorporated into the blankets 7, e.g. blankets could be attached to an underlying support belt using an adhesive or could be formed integrally with the belt. Given the length of the blanket belt 15, a relatively large number of blankets will be defined by the belt. This number is certainly higher then the number of different blankets provided for by the decorator of FIG. 1 (i.e. eight). A decorator making use of a continuous blanket belt might, for example, enable one hundred and fifty different secondary images to be produced on a single production line.

A number of alternatives and/or additions to the use of blanket printing surface variations to enable the printing of multiple different secondary images will now be described.

Blanket Force Variation

Figure 10:
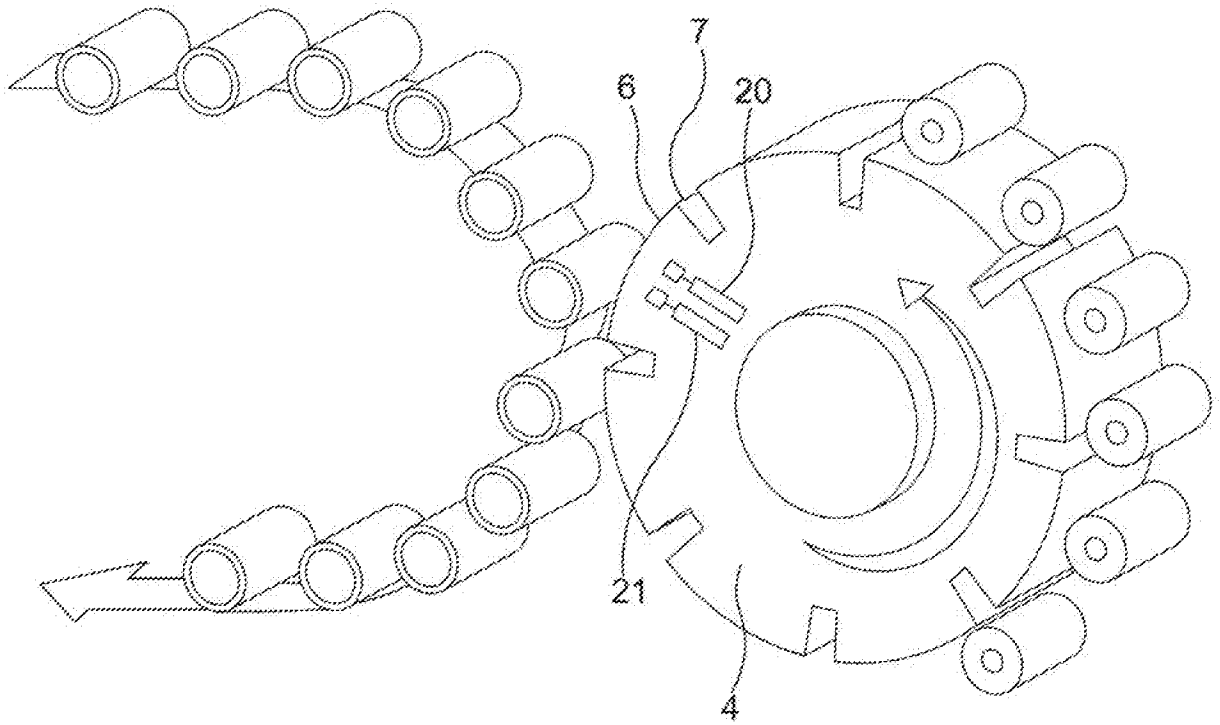
FIG. 10 illustrates schematically a modified can decorator apparatus introducing a blanket force application feature.

FIG. 10 illustrates a first variation comprising an overall process and mechanism similar to that described with reference to FIG. 1. Whilst it is envisaged that the blankets 7 will not have any variations across their printing surfaces, i.e. these surfaces are smooth, that need not be the case and, e.g. secondary images could be etched into the blanket surfaces. A plurality of pistons or other force exerting means is incorporated into each blanket segment. One exemplary piston arrangement 20 is illustrated in FIG. 10 within one of the blanket segments 6.

Figure 11:
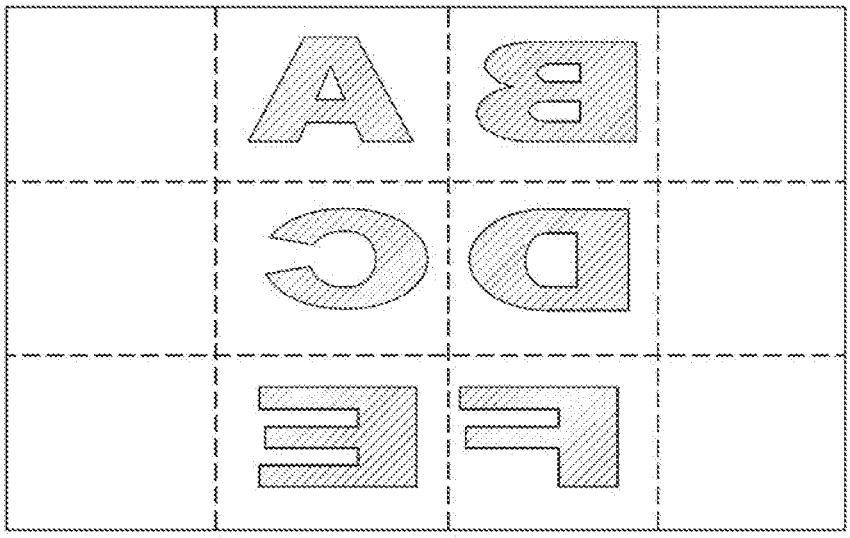
FIG. 11 illustrates schematically a blanket for use with the apparatus of FIG. 10.

The individual pistons 21 of the piston arrangement 20 are configured and operated to exert a radially inward force on a blanket 7 as it passes through the printing zone, i.e. during the can printing step and such that a piston causes an attached region of the blanket to be pulled inward, away from the printing zone. In an area where inward force is exerted on the blanket, no ink will be transferred to the can surface (or possibly only a "fuzzy" image will be printed if some minimal contact occurs). Assume for example that ink is transferred to a blanket surface to define a set of six characters on the blanket as illustrated in FIG. 11. These characters define a set of six alternative secondary images. The piston arrangement for the corresponding blanket segment comprises an array of six pistons configured to sit behind respective characters. As the blanket enters the printing zone, a given set of five pistons 21 are activated to pull the corresponding areas of the blanket print surface out of contact with the can. This will cause only one of the characters to be printed onto the can, e.g. "A". As the next blanket enters the print zone, a corresponding piston arrangement has a second set of five of its pistons activated, causing printing of only the second letter "B". This is repeated in cyclical order so that successive cans have a different one of the six characters printed onto them. It will be appreciated that other areas of the blanket are permanently raised with respect to the can surface to allow printing of the same primary image onto all cans.

Variable Printing Plates

In the embodiment described with respect to FIGS. 1 to 8, each of the ink stations 5 comprises a "plate cylinder" (not shown) having one or more printing plates mounted on its surface. These plates have fixed images formed (i.e. embossed or etched) on their surfaces. Changing a plate is a relatively time consuming exercise and necessarily interrupts the production line. In order to allow images to be changed during production, or during only very short interruptions, dynamically configurable printing plates may be introduced into one or more of the ink stations.

Figure 12:
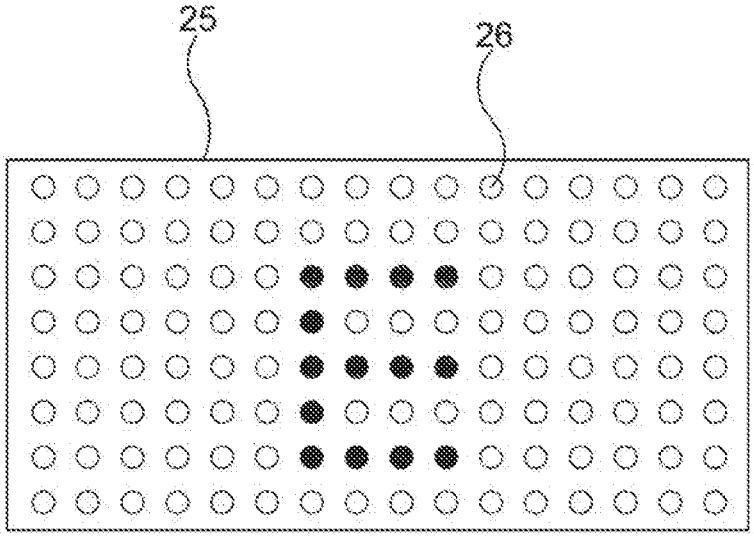
FIG. 12 illustrates a dynamically variable printing plate for use with a can decorator.

Consider for example a printing plate 25 comprising a relatively large matrix of electrically driven and individually addressable pins 26, such as is illustrated in FIG. 12. [NB. Whilst the plate shown in FIG. 12 is flat, in practice the plate will be curved in order to wrap around the surface of the plate cylinder.] Each pin 26 can be separately raised and lowered with respect to the surface of the plate cylinder, allowing a pattern to be dynamically "embossed" on the printing plate 25. In FIG. 12, the plate is shown embossed with the letter "E". Of course, the raised pins must be supported from beneath with sufficient strength to allow them to resist the relatively high forces applied to the pins during printing onto passing blankets. In a typical production process, the pins may be reconfigured, for example, following each rotation of the blanket wheel. This approach may require blankets having a harder surface than conventional blankets. Of course, such dynamically configurable printing plates 25 may be introduced into one or more of the ink stations.

Multiple Printing Plate Ink Station With Variable Speed

As has been noted above, it is known in the prior art to provide two different printing plates on an plate cylinder at a given ink station in order to allow different images to be transferred to successive blankets. Of course, to ensure that a given image is able to encompass the entire surface of a can, the circumference of the plate cylinder must be at least twice that of a conventional plate cylinder. Such larger plate cylinders clearly require significant redesign of the can decorator. It becomes increasingly difficult to accommodate more than two printing plates on a single plate cylinder.

Figure 13:
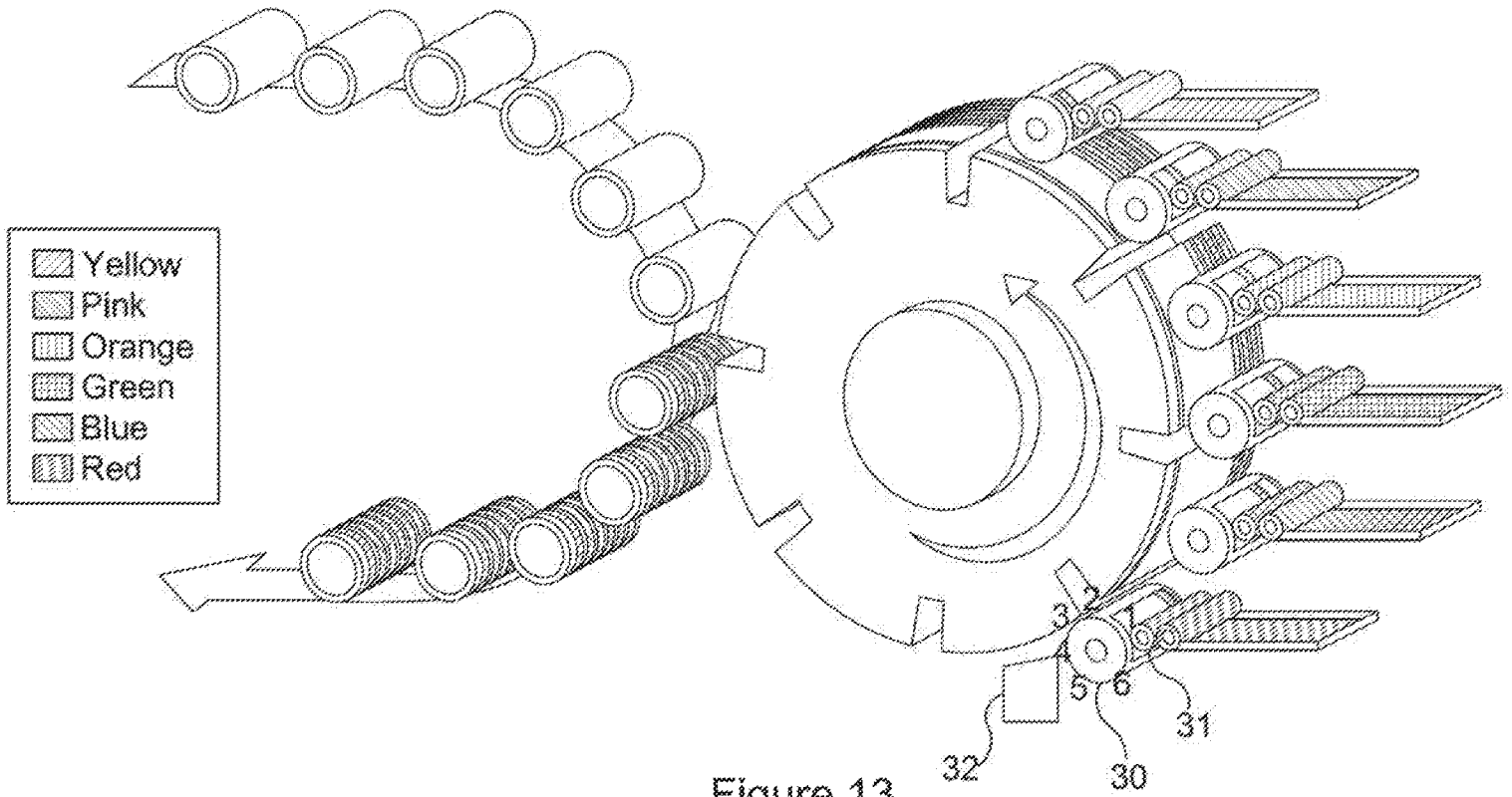
FIG. 13 illustrates schematically a can decorator including a multiple printing plate ink station with variable speed.

FIG. 13 illustrates a possible solution to this problem and involves incorporating into one of the ink stations a plate cylinder 30 of standard dimensions (i.e. having a circumference equal to the blanket pitch) adapted to accommodate multiple printing plates 31 (six in the illustrated example identified as plates 1 to 6). It will no doubt be observed that, if the plate cylinder 30 is completely free to rotate with the blanket wheel (as is the case with the plate cylinders of the other ink stations), more than one printing plate 31 will be caused to contact the same blanket. This is clearly unacceptable, so in order to prevent it happening a variable speed drive mechanism 32 is coupled to the plate cylinder 30. The mechanism is controlled in order to cause the plate cylinder to be brought towards and withdrawn from the blanket wheel depending upon the relative positions of the printing plates and passing blankets.

Considering this operation in more detail, during printing the plate cylinder 30 rotates at its "normal" speed. When the trailing edge of a given printing plate meets the blanket, the plate cylinder is withdrawn. Any remaining trailing region of the blanket remains un-inked by this ink station. The drive mechanism 32 then rotates the plate cylinder (now in the withdrawn position) at a slightly higher speed in order to align the position of the next printing plate with the next advancing blanket. The plate cylinder is then slowed back to its normal operating speed and is moved towards the next blanket in order to bring printing plate 2 into contact with the next blanket. [It will be appreciated that speeds and timings will vary slightly to accommodate the times taken to move the print cylinder in and out and to achieve acceleration and deceleration of the cylinder.]

An alternative to speeding up the plate cylinder in order to bring the next printing plate into alignment with the next blanket is to slow down the plate cylinder between ink transfer operations. It will be appreciated that, between printing plates a gap exists, during which there is no contact between the plates and the blankets. This allows the plate cylinder to be slowed without any damage being caused to either the plates or the blankets. The plate cylinder should be slowed down to such an extent that by the time the next blanket is in position, the gap between the trailing edge of the previous printing plate and the next plate has been closed.

Ink Transfer Through Stencil

Figure 14:
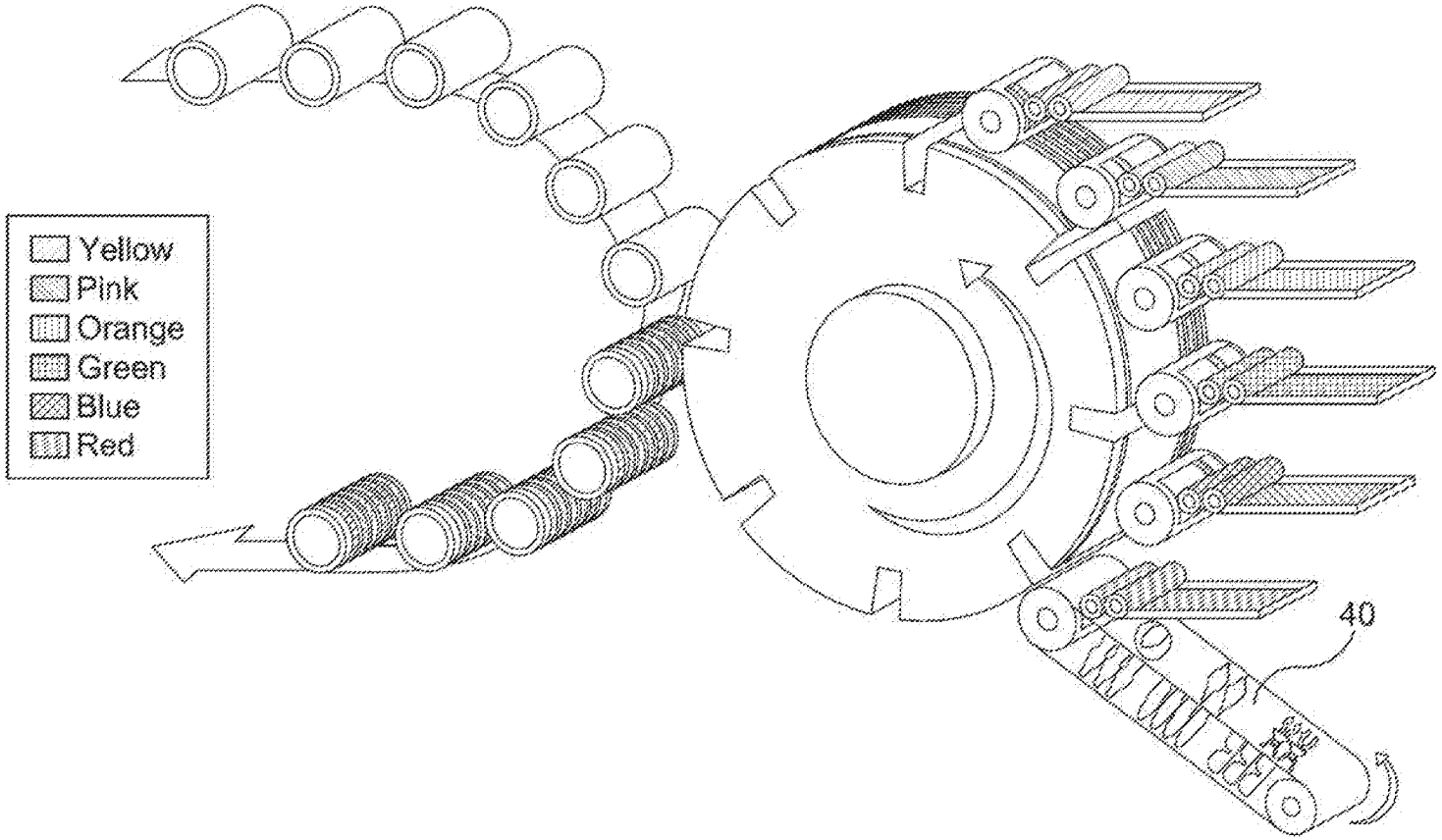
FIG. 14 illustrates schematically a can decorator including a modified ink station with stencil band.

FIG. 14 illustrates yet another alternative apparatus and process for printing multiple secondary image variants in a single can production line. In this apparatus a stencil belt 40 is incorporated into one of the ink stations. At an end closest to the blanket wheel the stencil belt travels around a modified plate cylinder. At an end remote from the blanket wheel the stencil belt travels around a second supporting roller (that may be free to rotate or may be driven). The stencil belt travels around the supporting rollers in a direction opposite to that of the rotating blanket wheel. Stencils or otherwise embossed or etched patters are provided at spaced apart intervals on an outer surface of the belt. It is this outer surface of the belt that has ink applied to it by a series of inking rollers. The spacing of the patterns is such that the patterns are presented in turn to successive blankets passing through the ink station. The belt may be made appropriately durable by forming the stencils or patterns on a metal backing. It will be appreciated that it may be necessary to introduce spaces into the belt between successive stencils in order to avoid undesirable inking of the blanket. This is not necessary where embossed patterns or printing plates are provided in place of stencils.

This approach of using an extended belt of patterns effectively increases the number of different patterns that can be printed within a single production line. In contrast to the previously described "variable speed" apparatus and process, the use of a continuous belt does not require any speed variations.

Selective Ink Removal

Figure 15:
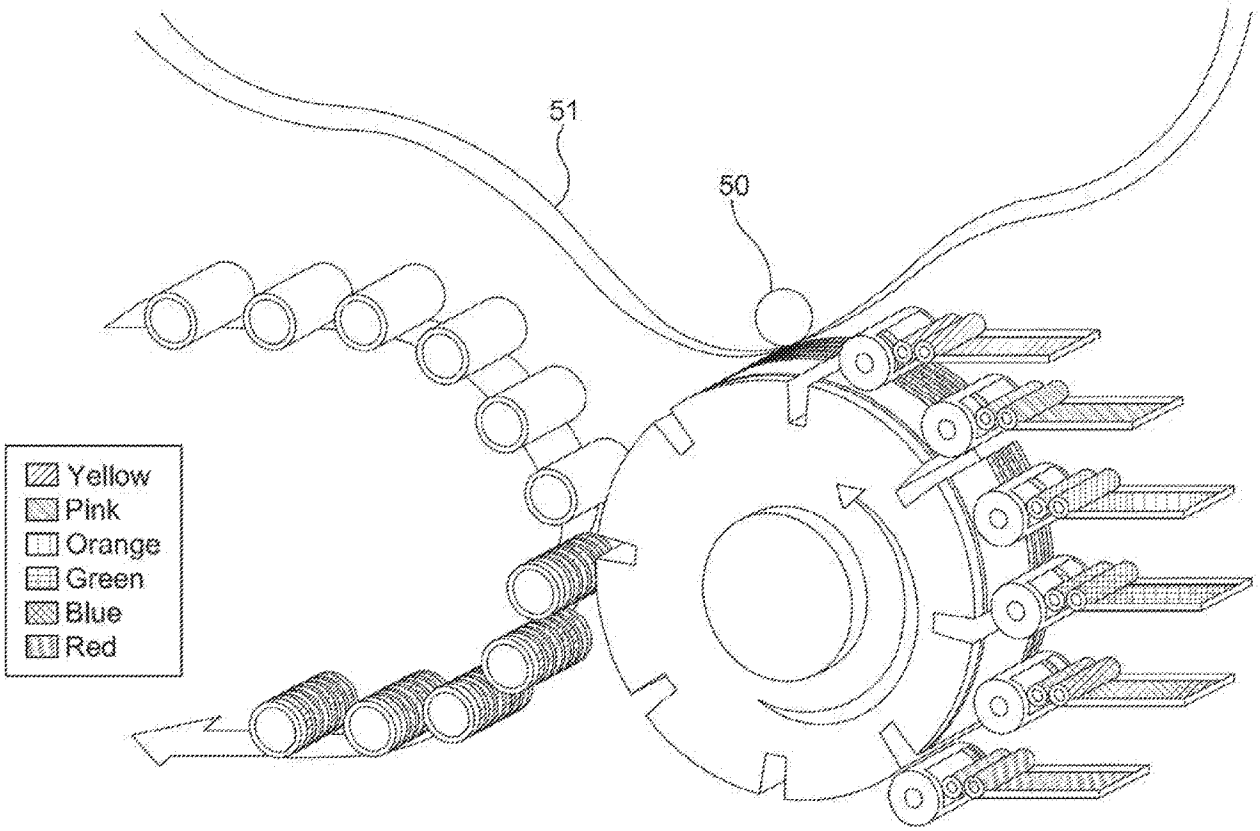
FIG. 15 illustrates schematically a can decorator with ink removal station.

Yet another alternative apparatus and process involves the use of a mechanism to selectively remove ink from a blanket. This is illustrated in FIG. 15. It is assumed that one or more of the ink stations will, for example, produce on each of the blankets a single colour across a particular region. Other areas will be inked with the primary image to be transferred to cans. The apparatus include an ink removal station 50 that is configured to remove a variable pattern of ink from each of these particular regions. The ink removal station 50 might, as illustrated, comprise an effectively continuous (or at least very long) ribbon 51 onto a lower surface of which are printed or otherwise formed adhesive patterns 52. Each adhesive pattern may be formed by printing or otherwise applying adhesive onto the ribbon. A roller mechanism (not shown) is incorporated into the ink removal station 50 to pull the ribbon through the station, bringing the lower surface of the ribbon into contact with the blankets as they pass through the ink removal station. Ink is removed from the blankets where contact is made with the adhesive patterns. It will be appreciated that a large variety of adhesive patterns can be "printed" along the ribbon allowing an equally high number of different secondary images to be printed onto cans passing through the can decorator.

It will be appreciated by the person of skill in the art that various modifications may be made to the above described embodiment without departing from the scope of the present invention.

The invention claimed is:

1. An apparatus comprising:

a can body conveying mechanism for conveying can bodies to a printing zone;

a blanket wheel comprising:

a plurality of blanket segments and, a plurality of blankets, each blanket affixed to a corresponding blanket segment, each blanket having a printing surface, the blanket wheel being configured to bring each blanket printing surface into contact with a can body within said printing zone; and an ink station comprising a printing plate configured to contact the printing surfaces of passing blankets in order to impart a primary ink image to the printing surfaces of the plurality of blankets, the primary ink image including a composite ink image and a primary unprinted region that is unprinted onto the blanket, the primary ink image is adapted to be formed on at least one blanket printing surface and is adapted to be printed onto a can body upon contact of the at least one blanket printing surface and the can body within the printing zone, wherein, each blanket printing surface comprises a secondary image surrounded by a secondary unprinted region having a lower or reduced height with respect to the blanket printing surface such that the secondary image is adapted to be printed on a can body as a positive image, and wherein the printing plate and the at least one blanket are configured such that said secondary unprinted region lies wholly within the primary unprinted region of the primary ink image that is unprinted onto the blanket.

2. An apparatus according to claim 1, wherein:

said blankets or at least a layer of said blankets presenting the printing surface are removably attached to respective blanket segments and each blanket and or blanket segment is provided with alignment features in order to allow the blankets and blanket segments to be correctly aligned such that, for each blanket printing surface, a composite ink image is correctly aligned; and said alignment features comprising printed or scored features on the printing surface of a blanket.

3. An apparatus according to claim 2 further comprising an alignment device, the alignment device being removably attachable to a blanket segment of the plurality of blanket segments, the alignment device further comprising an alignment surface against which a blanket can be positioned in order to allow the blankets and blanket segments to be correctly aligned such that, for each blanket printing surface, a composite ink image is correctly aligned with a secondary image.

4. An apparatus according to claim 3, wherein said alignment surface is single edged such that the blanket is supported at its trailing edge and a machine side of the blanket segment, flush fit to the trailing edge and with its lateral position determined by a profiled bar of the alignment device.

5. An apparatus according to claim 1, wherein the blankets each comprise a section of a continuous blanket belt that is secured around the periphery of the blanket wheel, on top of the blanket segments.

6. An apparatus according to claim 1, wherein the ink station is a first ink station and the printing plate is a first printing plate and the apparatus further comprises a second ink station having a second printing plate configured to contact the at least one blanket printing surface to form the secondary image.

7. An apparatus according to claim 1, wherein the plurality of blankets includes a first blanket of the plurality of blankets and a second blanket of the plurality of blankets and the secondary image is a first secondary image and the at least one blanket printing surface includes a first blanket printing surface of the first blanket of the plurality of blankets that defines the first secondary image and a second blanket printing surface of the second blanket of the plurality of blankets that defines a second secondary image that is different in form from the first secondary image.

8. An apparatus comprising:

a can body conveying mechanism for conveying can bodies to a printing zone;

a blanket wheel comprising:

a plurality of blanket segments and, a plurality of blankets, each blanket affixed to a corresponding blanket segment, each blanket having a printing surface, the blanket wheel being configured to bring each blanket printing surface into contact with a can body within said printing zone; and an ink station comprising a printing plate configured to contact the printing surfaces of passing blankets in order to impart a primary ink image to the printing surfaces of the plurality of blankets, the primary ink image including a composite ink image and a primary unprinted region that is unprinted onto the blanket, the primary ink image is adapted to be formed on at least one blanket printing surface and is adapted to be printed onto a can body upon contact of the at least one blanket printing surface and the can body within the printing zone, wherein each blanket printing surface comprises a secondary image, the secondary image including a positive image within a surrounding area of lower or reduced height with respect to the blanket printing surface such that the positive image is adapted to be printed on a can body as a positive image, wherein a surface area of the secondary image is substantially the same for each of the plurality of blankets, and wherein the printing plate and each of the plurality of blankets are configured such that said surrounding area lies wholly within the unprinted region of the primary ink image.

9. An apparatus according to claim 8, wherein the positive image varies between each of the plurality of blankets.

* * * * *